United States Patent [19]

Switzer

[11] Patent Number: 4,920,780

[45] Date of Patent: May 1, 1990

[54] HYDRAULIC RAM RAIL BENDER

[75] Inventor: Ralph V. Switzer, Waukegan, Ill.

[73] Assignee: The Aldon Company, Waukegan, Ill.

[21] Appl. No.: 361,331

[22] Filed: Jun. 5, 1989

[51] Int. Cl.[5] ..... B21D 9/08

[52] U.S. Cl. ..... 72/389; 72/380

[58] Field of Search ..... 72/212, 391, 389, 380

[56] References Cited

U.S. PATENT DOCUMENTS

| | | | |
|---|---|---|---|
| 520,876 | 6/1894 | Brown | 72/389 |
| 630,484 | 8/1899 | Brown | 72/389 |
| 3,908,425 | 9/1975 | Ware | 72/389 |
| 4,141,235 | 2/1979 | Ishihara | 72/389 |
| 4,254,651 | 3/1981 | Kelly | 72/389 |
| 4,483,175 | 11/1984 | Hansen | 72/389 |

FOREIGN PATENT DOCUMENTS

| | | | |
|---|---|---|---|
| 1353336 | 1/1964 | France | 72/389 |
| 92853 | 11/1958 | Norway | 81/15 |
| 362586 | 7/1962 | Switzerland | 72/389 |

*Primary Examiner*—David Jones

[57] ABSTRACT

A rail bender designed for bending and/or straightening flat bottomed rails of various sizes. The bender consists of a double triangular frame, one angle of which is fitted with a center counter brace swivelable about a removable spindle. Two single action hydraulic rams are carried adjacent the other angles of the triangular frame with such rams provided with bending blocks that are swivelably fixed to the free ends of a threaded ram extender shaft fitted within each ram whereby each block is axially adjustable relative to the ram whereby such blocks are positionable against the head and base of the rails to be bent or straightened regardless of their size.

4 Claims, 3 Drawing Sheets

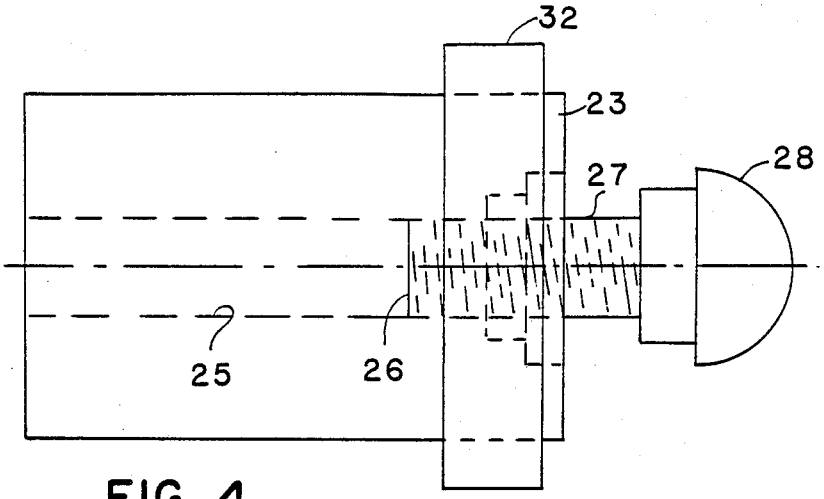
FIG. 4
FIG. 5
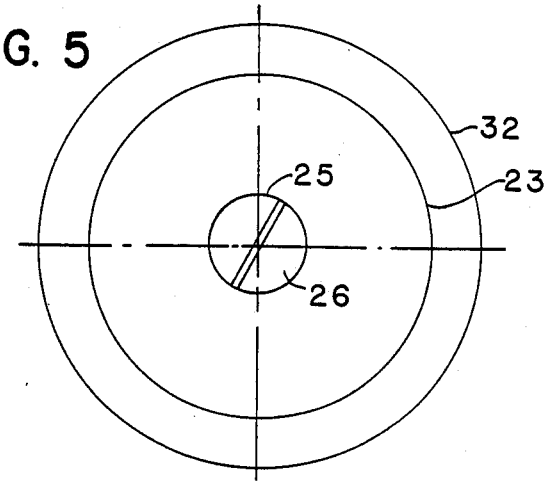
FIG. 6
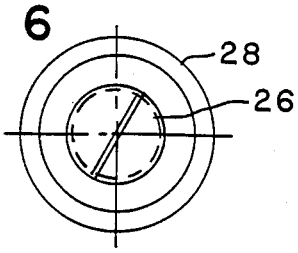

HYDRAULIC RAM RAIL BENDER

BACKGROUND OF THE INVENTION

Rail benders have generally been constructed so as to provide a single point center brace post from which extends angled arms forming a substantially triangular frame, with the free ends of the arms supporting hydraulic cylinders that include rams for engaging and bending a rail about the center brace post.

These basic prior devices were primarily designed for bending rails and therefore when the device was required to be used as a rail straightener the ram heads were required to be rotated so as to engage the vertical portion of the rail at which points straightening forces was applied at such rail portions rather than at the rail's head and base. The most vulnerable part of the rail, is through its vertical portion as this is the thinnest area of the entire rail structure. By applying any force to such vertical portion of the rail, distortion and warping of the rail is produced thereby effecting it's stability as a supporting structure for trains and the like.

SUMMARY OF THE INVENTION

The rail bender of this invention is designed for bending and straightening all flat bottomed rails, such as railroad tracks and the like. The bending and/or straightening operation is accomplished without the necessity of removing or replacing any parts of the rail bender.

The bender is provided with a frame which consists of two triangular sections which are joined together in spaced relation at their respective angles. One angle of the frame is provided with a removable spindle which positionably supports between the triangular sections a swivelable counter brace. The remaining angled ends of the triangular frame carry single action hydraulic cylinders which include reacting rams. Each of the rams are provided with a threadable extension shaft, the ends of which include a semi-spherical swivel connecting head which is adapted to carry a bending block.

The ram extension shaft is adapted to be threadably connected to the ram through a tapped center bore and is available therethrough by a suitable tool whereby the extension may be adjusted axially with respect to the ram. This feature permits the bender to be readily adjusted to rails of different sizes without affecting the stroke travel of the ram, thus permitting the bender to be used for bending or straightening rails.

BRIEF DESCRIPTION OF THE DRAWINGS

The invention will be best undertstood by reference to the accompanying drawings which show the preferred form of construction and mode of operation by which the objects of the invention are achieved, and in which:

FIG. 4 is a detailed sectional view of the rail bender ram and its adjustable extension head;

FIGS. 5 and 6 are end views illustrating the symmetrical relationship of the ram and its adjustable extension member.

GENERAL DESCRIPTION OF THE INVENTION

Figure 1:
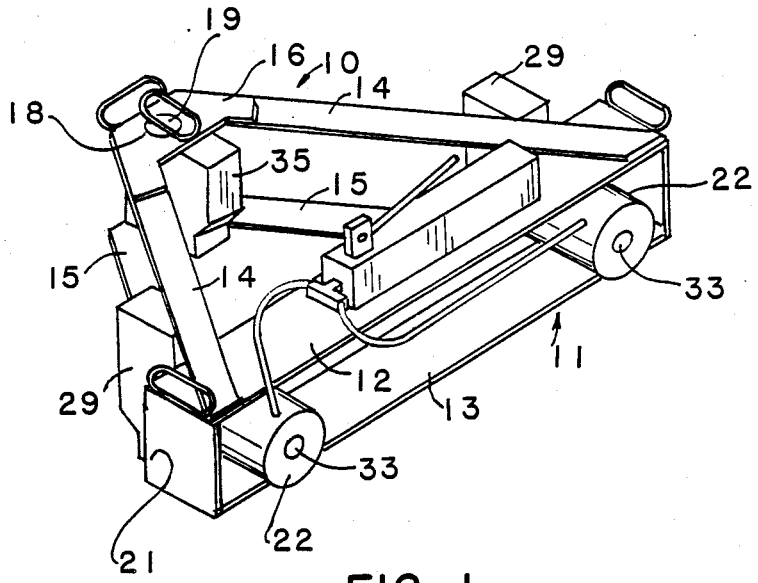
FIG. 1 is a perspective view of the rail bender of this invention.

The rail bender of this invention includes a basic frame structure 10 consisting of a generally box-like base member 11. Mounted on the parallel arms 12 and 13 of the base member 11 and extending in a converging manner so as to form a substantial triangular structure are two pairs of struts 14 and 15. The free ends of the struts are joined by overlapping end plates 16 and 17, each of which is provided with an aligned center opening 18 through which a removable spindle 19 is adapted to be projected. This spindle 19 will removably and swivelably support a center counter brace 20.

Between the arms 12 and 13 of the base member 11 adjacent the opposite ends thereof and carried by its bight portion 21 is a set of hydraulic cylinders 22. Each of the cylinders 22 provides a ram 23 which is adapted to project through a suitable opening 24 formed in the bight portion 21 of the base member 11 as seen in FIG. 3.

One of the rams 23 is illustrated in FIG. 4 and as such is shown to provide a center tapped bore 25 which threadably receives the extension shaft 26 of a ram extender 27. The free end of the shaft 26 of the ram extender 27 has mounted thereon a semi-spherical bending block supporting head 28. As shown in FIG. 3 a bending block 29 provides a receiving socket 30 for such head 28 which in turn is freely retained in the socket 30 by a split ring washer 31.

Figure 2:
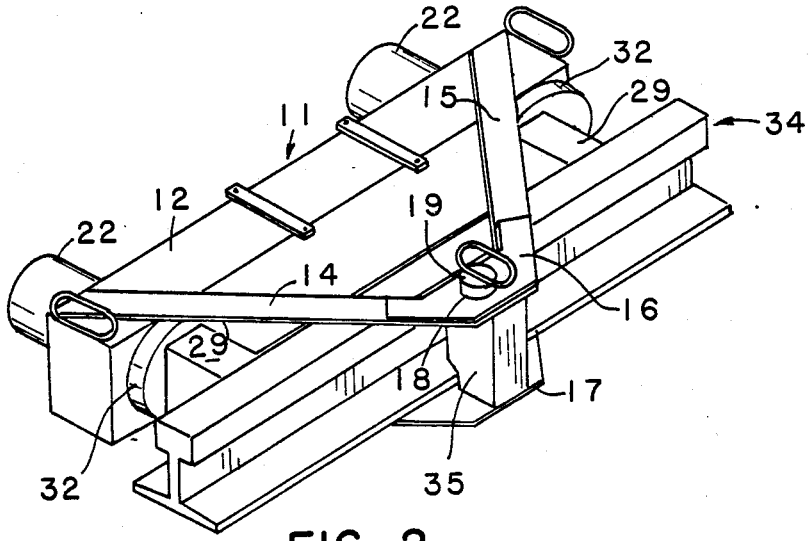
FIG. 2 is a reverse angle perspective view of the invention.
Figure 3:
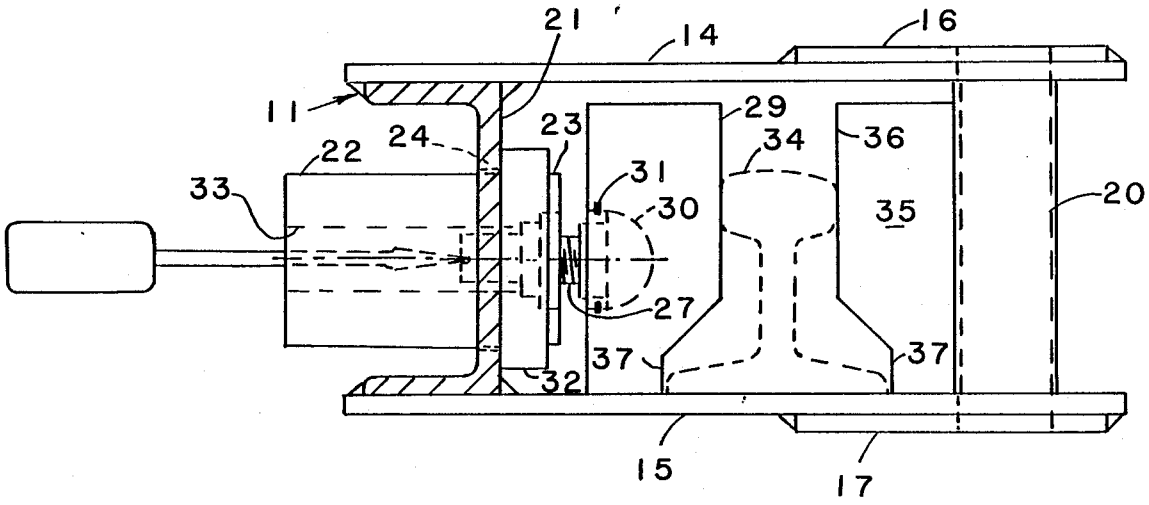
FIG. 3 is a detailed sectional view of the adjustable structure of the rail bender.

As illustrated in FIGS. 1 and 2 the hydraulic cylinders 22 are positioned between the arms 12 and 13 of the base member 11 and include a retainer head 32 which engages the opposite face of the bight portion 21 of the base member 11 (see FIGS. 2 and 3). The ram 23 is contained within the cylinder 22 such that the access opening 33 formed in the cylinder 22 will be in axial alignment with the center tapped bore 25 of the ram 23 as illustrated in FIG. 3.

When the device is to be used the spindle 19 is removed thus permitting the center counter brace 20 to be displaced from the frame 10 while the rail 34 is positioned within the triangular arms 12 and 13 as shown in FIG. 3. The center brace 20 will include a bending block 35 which is of a like configuration to the bending blocks 29 associated with each of the rams 23. As such, and as clearly shown in FIG. 3, the blocks 29 and 35 provide a rail head engaging face 36 as well as a recessed rail base contacting surface 37. By this arrangement the block 35 is swivelable about the spindle 19 so as to properly engage the rail head and base, just as the blocks 29 are free to align themselves with the rail head and base through their socket containment of the semi-spherical supporting head 28 of the bending blocks 29.

Without sacrificing the length of the stroke of the rams 23 the bending blocks 29 may be horizontally adjusted relative to the rail 34 by the simple threading of the extension shaft 26 through the bore 25 of each of the rams 23.

From the foregoing I have described a hydraulic rail bender that is simple in use, economical in manufacture and highly effective for the purposes of bending or straightening rails of various sizes. By the arrangement of parts and the adjustability of the rail contact, the bending forces are applied upon the rail head and base for proper bending or straightening.

While I have illustrated and described the preferred form of construction for carrying my invention into effect, this is capable of variation and modification without departing from the spirit of the invention. I therefore, do not wish to be limited to the precise details of construction as set forth, but desire to avail myself of such variations and modifications that come within the scope of the appended claims.

Having thus described my invention what I claim as new and desire to protect by Letters Patent is:

1. A rail bender having a substantially triangularly shaped frame having at its angled portions rail engaging bending blocks spaced to receive therebetween the rail to be bent, with one block being stationary yet swivelable about a vertical axis while the remaining set of opposing bending blocks are movable through a horizontal plane in the direction of the stationary block and against the rail to be bent, wherein the improvement comprises:

(a) a set of hydraulic cylinders having expellable rams in contact with said set of bending blocks for moving the same under pressure against the rail to be bent as it is held by said stationary block, (b) means mounting said set of bending blocks to said rams including a swivel head and socket arrangement with said rams providing said swivel heads and said blocks formed to provide the receiving and retaining socket, (c) means for adjusting the length of movement of said rams and said set of blocks toward the stationary block so as to accommodate rails of various sizes and to vary the degree of bend of the rail about the stationary block.

2. A rail bender as defined by claim 1 and including a ram extender manually movable axially of said hydraulic cylinders so as to adjust the length of the stroke of said rams by said cylinders.

3. A rail bender as defined by claim 2 wherein said ram extender comprises an elongated threaded shaft, threadable axially through a center tapped bore formed in said ram, with the free end of said shaft carrying the rail bending block.

4. A rail bender as defined by claim 1 wherein said means for adjusting the length of the stroke of said moving means comprises an elongated threaded shaft, threadable axially through a center tapped bore formed in said ram, with the free end of said shaft carrying the rail bending block.

* * * * *